United States Patent [19]

Ronden et al.

[11] Patent Number: 4,477,337

[45] Date of Patent: Oct. 16, 1984

[54] METHOD FOR REMOVING SOLIDS AND WATER FROM PETROLEUM CRUDES

[75] Inventors: Clifford P. Ronden, Edmonton, Canada; Donald C. Boylance, Potomac, Md.

[73] Assignee: Husky Oil Operations Ltd., Calgary, Canada

[21] Appl. No.: 522,651

[22] Filed: Aug. 12, 1983

Related U.S. Application Data

[63] Continuation of Ser. No. 397,935, Jul. 13, 1982, abandoned.

[51] Int. Cl.[3] ..... C10G 33/04

[52] U.S. Cl. ..... 208/188; 208/226; 208/229; 208/230

[58] Field of Search ..... 208/188, 229, 230, 226

[56] References Cited

U.S. PATENT DOCUMENTS

| | | | |
|---|---|---|---|
| 2,020,661 | 11/1935 | Schulze et al. | 208/230 |
| 2,446,040 | 7/1948 | Blair, Jr. | 208/188 |
| 2,761,755 | 9/1956 | Brown | 208/229 |
| 3,130,142 | 4/1964 | Nathan et al. | 208/188 |
| 3,396,100 | 8/1968 | Pettefer | 208/188 |
| 3,547,803 | 9/1968 | Barkman, Jr. et al. | 208/188 |
| 4,029,570 | 6/1977 | Coffman et al. | 208/188 |
| 4,180,457 | 12/1979 | Popp et al. | 208/188 |
| 4,272,360 | 6/1981 | Bialek | 208/188 |

*Primary Examiner*—Delbert E. Gantz
*Assistant Examiner*—Cynthia A. Prezlock
*Attorney, Agent, or Firm*—Roylance, Abrams, Berdo & Goodman

[57] ABSTRACT

Petroleum crudes, particularly heavy oil crudes produced by thermal or other enhanced recovery procedures, are treated to break the water-in-oil emulsion and reduce the BS&W content by use of additives, advantageously ammonium bisulfite, which act upon inorganic sulfur contained in the crude.

10 Claims, 4 Drawing Figures ml OF 32% AQUEOUS NAOH
IN BLEND OF 40 ml ABERFELDY
CRUDE WITH 42 ml XYLENE
AND 18 ml ISOPROPANOL
CRUDE pH = 6.7 CRUDE BS&W = 13% CRUDE API = 20.9

METHOD FOR REMOVING SOLIDS AND WATER FROM PETROLEUM CRUDES

This is a continuation of application Ser. No. 397,935 filed July 13, 1982, now abandoned.

This invention relates to the treatment of heavy oil crudes, particularly crudes resulting from enhanced oil recovery practices, especially thermal practices such as fireflooding and steamflooding, to bring the crude to pipeline specifications.

RELATED APPLICATIONS

Subject matter disclosed in this application is also disclosed and claimed in copending applications Ser. No. 397,934 and Ser. No. 397,696, both filed concurrently herewith by Clifford P. Ronden.

BACKGROUND OF THE INVENTION

As produced at the wellhead, crude oils contain substantial quantities of water and inorganic particulates, and it has long been standard practice to require that the combined solids and water (BS&W) content be reduced to a value not exceeding a stated small percentage before the crude is introduced to a pipeline or supplied to a refinery. Such reduction of the BS&W content is necessary both to minimize damage to pipeline and refining equipment from, e.g., corrosion and abrasive wear, and to minimize losses arising from transporting and processing the non-petroleum constituents making up the BS&W content. Though specifications vary among localities and refineries, a typical specification requires that the BS&W content of the crude not exceed 0.5% by volume.

The BS&W content of many crudes can be brought within specifications simply and easily, as by gravitational separation and, when required, addition of various treating agents. However, the heavy oil crudes, and especially those produced by fireflooding or other thermal recovery practices, have presented a more serious problem and no completely satisfactory method has heretofore been available for reducing the BS&W content of such crudes. Such crudes are highly viscous, so that the raw crude must in all events be diluted with, e.g., a wide gasoline fraction, commonly called condensate, to achieve adequate fluidity for handling and treatment. Even thus diluted, however, simple settling operations, even for extended times, do not result in separation of the water from the oil, and it is commonly recognized that a substantial part of the remaining water is present as the disperse phase of a water-in-oil emulsion. Attempts to break the emulsions in such crudes have met with little success in many cases, and much attention has been given to the emulsion breaking problem by workers in the field. Heretofore, it has commonly been thought that, when the BS&W content of a heavy oil crude could not be brought within pipeline specifications, a primary cause was stabilization of the emulsion by very small particles of clay or the like distributed at the interfaces between the water globules of the disperse phase and the oil of the continuous phase. Other theories blame the high inherent viscosity of the crude and the presence of asphaltic and resinous constituents. Despite the severity of the problem and the diversity of theories as to its causes, efforts to reduce the BS&W content of such crudes below pipeline specifications frequently fail completely, causing the operator of the wells to resort to such expensive expedients as blending the high BS&W crude with a clean crude in order to reach specifications. In some instances, the BS&W content of the crude, even after treatment, remains so high that the crude must be considered unsuitable for normal refining. There has thus been a continuing need for a method which will break the emulsion of such crudes and accomplish a good separation of solids and water from the oil.

OBJECTS OF THE INVENTION

A general object of the invention is to devise a method by which the BS&W content of difficultly treatable heavy oil crudes can be reduced to acceptable levels.

Another object is to provide a method for breaking the especially tight emulsions of heavy oil crudes produced by enhanced recovery procedures.

A further object is to provide an economically practical method which is capable of reducing to an acceptable level the BS&W contents of a wide range of heavy oil fireflood and steam flood crudes.

SUMMARY OF THE INVENTION

The invention is based in part on the discovery that, contrary to prior-art beliefs, the usually expected inorganic particulates such as clays and silica appear to play little if any part in stabilizing the oil-in-water emulsions of the more difficultly treatable heavy oil crudes, and in part on the observation that such crudes contain a ubiquitous sulfur-rich inorganic constituent, believed to be elemental sulfur, in very finely particulate form.

Broadly considered, the method of the invention is characterized by providing in the crude, while the crude is at a pH of at least 8, advantageously at least 10, a uniformly distributed small proportion of at least one inorganic additive effective at least to change the form of the inorganic sulfur constituent and advantageously to combine with at least a portion of that constituent under the conditions of treatment, the crude then being heated at 52°-88° C. (125°-190° F.), advantageously 60°-71° C. (140°-160° F.), for from a few minutes to a few hours depending upon the particular crude, the temperature employed and other process variables. Advantageously, the crude is diluted with water prior to the heating step. The treated crude is then subjected to a separating step to recover the clean oil from the water and solids. The high pH is critical to success of the method and can be obtained by addition of any inorganic base selected from the group consisting of the alkali metal, alkaline earth metal and ammonium hydroxides. The inorganic additive employed to affect the sulfur constituent of the crude can be any inorganic compound, or combination of compounds, to which the oil is essentially inert and which will react with or change the form of the sulfur ingredient of the crude, the monosulfides and hydrosulfides of the alkali metals, alkaline earth metals and ammonium being suitable. Alternatively, any inorganic compound which will react under the conditions of the treatment to yield such a compound can be used, the alkali metal, alkaline earth metal and ammonium hydrosulfites being suitable. The heavy oil crude to be treated can be one which has been preliminarily treated for reduction of the BS&W content. The method thus advantageously includes the preliminary steps of diluting the raw crude with a compatible hydrocarbon diluent, typically a wide gasoline cut (condensate), removing free water by gravity separation, and recovering the oil phase as a blended crude having an API gravity of at least 17. Crudes thus diluted and additionally treated with a surfactant or other chemical treating agent, but with that treatment failing to bring the BS&W content to pipeline specifications, can also be treated according to the invention. The method can be used advantageously to treat blends of a plurality of different heavy oil crudes. Thus, for example, where a number of heavy oil crudes are produced in each of two or more fields, and each field employs one or more conventional treaters, the crudes available at each treater can be blended with condensate, free water removed in a gravity separator, and the recovered blended crude then delivered to a central treating station to be combined with like crudes from a different field, and the combined crude then treated according to the invention.

In practice, the method need not, and usually does not, remove all of the inorganic sulfur from the oil, though a significant proportion of the inorganic sulfur is always removed as a result of the method. Though the particular manner in which the inorganic sulfur acts in the emulsion is not yet known with certainty, it is apparent that the method results in breaking the emulsion of the crudes and, in doing so, acts upon the inorganic sulfur constituent to cause a significant proportion of that constituent to appear in the phase or phases from which the clean oil has been separated.

IDENTIFICATION OF THE DRAWINGS

In order that the manner in which the foregoing and other objects are attained according to the invention can be understood in detail, particularly advantageous embodiments thereof will be described with reference to the accompanying drawings, which form part of the original disclosure of this application, and wherein:

FIGS. 1–3 are flow sheets each illustrating a different embodiment of the invention; and FIG. 4 is a titration curve showing the proportions of alkaline additive typically required to raise the pH of a heavy oil crude.

DETAILED DESCRIPTION OF THE INVENTION

Characterization of Heavy Oil Crudes

Figure 1:
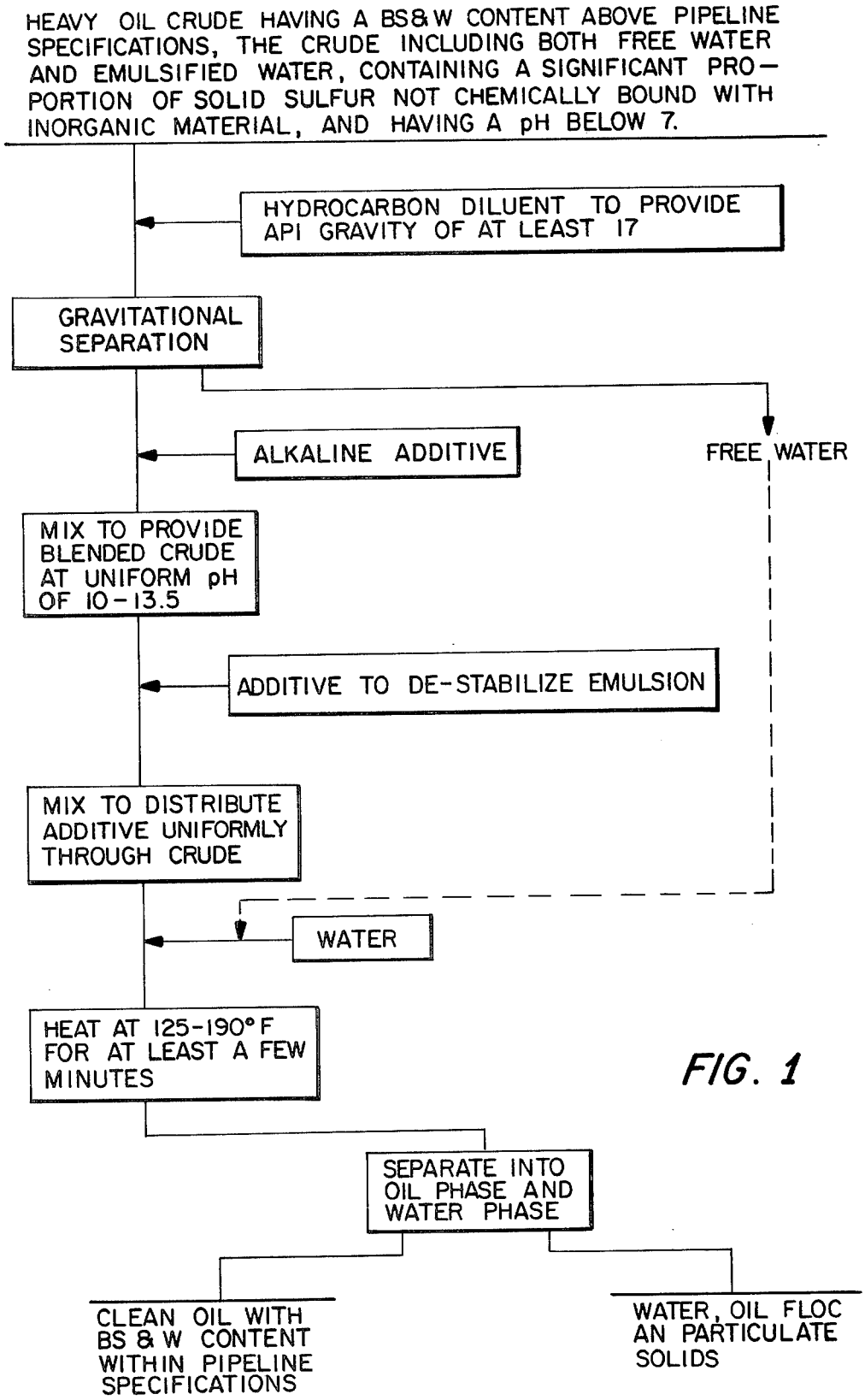

Though broadly applicable to heavy oil crudes having a substantial water content present in the form of very fine droplets as the disperse phase of a water in oil emulsion and also containing a significant proportion of finely divided inorganic sulfur, the invention is especially useful for treating heavy oil crudes obtained by enhanced recovery procedures, particularly by fireflooding or steamflooding. Typical of the heavy oil crudes are those produced from the Cretaceous reservoirs in the Western Canada sedimentary basin, including the Cold Lake, Lloydminster and Medicine River fields. The Lloydminster crudes, including Husky Aberfeldy, Husky G.N.O.L. Golden Lake, Murphy Silverdale, Mobil-GC Silverdale, Mobil-GC Kitscoty and Brascan Lindbergh are specific examples of the heavy oil crudes to which the invention is applicable. Such crudes typically have an API gravity of 12–16, sometimes 10–15, a pH of 5.5–6.8, sometimes 4–8, and BS&W contents ranging to as much as 70% by volume. Though such crudes contain a substantial proportion of free water, i.e., water which separates reasonably promptly by simple gravity settling, a substantial part of the water content is emulsified water. Heretofore, no treatment has been available which would apply to this broad spectrum of heavy oil crudes and succeed consistently in reducing the BS&W content of 0.5% by volume.

Since the resistance exhibited by such crudes to usual treatments was thought to be caused at least in part by the emulsion-stabilizing effect of fine particulates such as clay, a study of such crudes was undertaken, using optical microscopy to characterize the nature of the emulsion and scanning electron microscopy (SEM) and energy dispersive X-ray spectrometry (EDXA) to characterize the particulate solids. From optical microscopy, it was found that such crudes are in the form of complex water-in-oil emulsions, in which the water droplets of the disperse phase contain some dispersed oil, and that the size of the disperse phase droplets is smaller than expected. Thus, in a Husky Aberfeldy fireflood crude sample taken at the wellhead without treatment, the water droplets of the disperse phase of the primary water-in-oil emulsion were found to be in the range of only 0.5–2.5 microns. Solid particulates observable were generally larger in size than the small water droplets. Working with the same sample, the crude was prepared for particle characterization by SEM and EDXA. Two drops of the crude were blended with 100 drops of hexane and the blend mixed ultrasonically. Ten drops of that blend were diluted with 100 ml of hexane, again with ultrasonic mixing. The resulting liquid was filtered through a 0.2 micron 47 mm polycarbonate membrane filter (NUCLEPORE, from Nuclepore Corp., Pleasonton, Calif.), the filter membrane was dried at room temperature in air, and a 1 cm. square section was cut from the center of the membrane and mounted on an SEM specimen stub. The dry membrane section was coated by vacuum deposition with carbon to a thickness of 200 Angstroms to provide electrical conductivity and the stub then mounted in a Hitachi HHS2R SEM fitted with KEVEX Model 500 energy dispersive X-ray spectrometer, and equipped with an automatic image analysis computer to provide a chemical particulate pattern recognition system (CPPRS). The same sample preparation procedure was followed for an additional Husky Aberfeldy fireflood crude taken at the wellhead without treatment. CPPRS analysis was supplemented by thermogravimetric (TGA), X-ray diffraction (XRD) and infrared spectroscopy (IR).

From the SEM, EDXA, XRD and IR data, it was concluded that the solid particulates present included halite, quartz, clays and sulfates, and the CPPRS data showed these particles to have a size range of 3.3–11 microns. Aside from these particulates, only one other constituent could be identified as a solid inorganic constituent in significant quantity. That constituent was identified by SEM observation and EDXA analysis as a ubiquitous film of fine (submicron to 1 micron) particles and particulate clusters containing sulfur as the only identifiable element. Since the filter employed for SEM sample preparation had pores of 0.2 micron size, and the sample preparation is not a standard procedure for crude oil analysis, additional procedures were devised and employed to determine that no fine particulates had passed through the filter so as to avoid detection. Also, the sulfur constituent was itself isolated and analyzed by SEM and EDXA, confirming the observations stated above. To isolate the sulfur constituent, light hydrocarbon ends were first removed conventionally from a sample of crude and the sample was then azeotropically distilled to remove water. The distilled sample was washed repeatedly with heptane with centrifugation, the supernatant solution of heptane-soluble hydrocarbons decanted, and the residue air dried. The air-dried sample was divided into two portions and one portion was extracted with toluene to leave a toluene-insoluble residue. On observation by SEM and EDXA, the residue sample not extracted with toluene was found to contain the same ubiquitous film of sulfur material observed in the original SEM/EDXA analysis, as well as the non-sulfur particulates. The residue sample which had been extracted with toluene was found to contain only those inorganic particulates other than the ubiquitous sulfur constituent. The air dried sample amounted to 2.27% of the weight of the crude. Upon drying at 110° C. for 2 hours, the sample lost 59.8% of its weight by volatilization of heavy hydrocarbon residuals of asphaltic character. The material remaining after drying at 110° C. amounted to 1.36% of the weight of the original crude. Toluene extraction removed solids amounting to 1.33% of the weight of the crude. Since SEM/EDXA analysis showed the toluene soluble portion of the residue to be the sulfur material, without other identifiable components, it is apparent that the original crude contained approximately 1.3% by weight of the ubiquitous sulfur constituent. Having been taken up by toluene but not by heptane, the sulfur constituent appears to be an inorganic sulfur material having the solubility characteristics of the rhombic and/or monoclinic crystalline form of sulfur.

Interpretation of the Analytical Data Upon Which the Invention is Based

Since the expected inorganic particulates found in the crude, including halite, quartz, clays and sulfates, are of a particle size which is generally larger than the water globules of the disperse phase of the emulsion, it appears unlikely that the usual particulates play a major role in stabilizing the emulsion of the crude.

Though the high viscosities of the heavy oil crudes certainly contribute to the stabilization of the emulsion, the unusual resistance of these crudes to conventional treatment after dilution with condensate indicates that other factors than mere viscosity are involved.

Since the analyses detected no unusual factor other than the size relation between the expected inorganic particulates and the disperse phase water globules, and the unexpected presence of the sulfur constituent, the sulfur constituent appears as the likely emulsion-stabilizing cause, and the examples described below confirm this conclusion. The precise role of the sulfur constituent in stabilizing the emulsion is not yet known with certainty. It may be that the sulfur is simply distributed in its sub-micron particulate form at the interfaces between the small water globules and the oil phase and acts to prevent the globules from coalescing. It also may be that the sulfur is present in inorganic polymer form, and is distributed in the oil in such a manner as to form especially tenaceous oil films surrounding the water globules and preventing the inter-globule contact necessary for the globules to coalesce. In all events, it has been discovered that whenever a uniform distribution through the crude of an inorganic additive capable of acting directly on the sulfur component while the crude is at a pH of at least 8, and advantageously at least 11, is achieved, the emulsion can be broken and clean oil of satisfactorily low BS&W content recovered.

Additives Employed to Destabilize the Emulsion

In its simplest forms, the method employs additives which react directly with the inorganic sulfur component to produce sulfur compounds which have a greater affinity for water, including greater solubility in water, than does the sulfur component itself. Typical of such additives are the alkali metal, alkaline earth metal and ammonium monosulfides and hydrosulfides. Typical reactions for NaHS are as follows:

$$NaHS + NaOH \rightarrow Na_2S + H_2O$$

$$Na_2S + 3S \rightarrow Na_2S_4$$

$$Na_2S_4 + S \rightarrow Na_2S_5$$

It is also to be noted that, when NaOH is employed as the alkalyzing agent, NaHS is inherently produced in the crude, as shown by the following equations:

$$4NaOH + 6H_2O + 12S \rightarrow 8H_2S + 2Na_2S_2O_5$$

$$H_2S + NaOH \rightarrow NaHS + H_2O$$

Also useful are those agents which will react under the conditions of treatment to yield in situ a compound or compounds capable of reacting with the sulfur component of the crude to produce a compound or compounds more soluble in or having an increased affinity for water, including greater solubility in water. Thus, recognizing that both an inorganic base and hydrogen sulfide are present after the crude has been alkalyzed, ammonium bisulfite is especially useful as the additive for destabilizing the emulsion, as are the hydrosulfites of alkali metals and alkaline earth metals. For ammonium bisulfite, the following reactions are explanatory:

$$4NaOH + 6H_2O + 12S \rightarrow 8H_2S + 2Na_2S_2O_5$$

$$2NH_4HSO_3 + 2NaOH + H_2S \rightarrow (NH_4)_2S + 2NaHSO_3 + 2H_2O$$

$$(NH_4)_2S + 4S \rightarrow (NH_4)_2S_5$$

While it is apparent that the additives employed to destabilize the emulsion do react with elemental sulfur, the SEM and EDXA analysis of clean oil and separated oil floc and solids obtained according to the method show that the reactions need not, and in practice do not, remove all of the finely divided sulfur components which appears to stabilize the emulsion. Some of the sulfur component is identifiable by SEM and EDXA in the oil floc separated from the oil along with the water and solids. But SEM and EDXA analysis also discloses that some of the sulfur component remains in the clean oil recovered by the method. And, as will be apparent from the examples later described, the method is successful when only a relatively small fraction, e.g., 6–15%, of the stoichiometric quantity of the destabilizing additive necessary for complete reaction with the sulfur component of the crude is employed. While the reasons for success are not completely understood, it is believed that the destabilizing effect of the additive employed results not just from removal by reaction of some of the sulfur component but also from a physical change, possibly a change in form of a polymeric sulfur or a simple displacement of the sub-micron particles of the sulfur component from the interfaces between the disperse phase globules and the continuous oil phase.

The Manipulative Procedure

All embodiments of the method depend upon achieving a thorough distribution of the emulsion destabilizing agent through the crude when the crude has been brought to an API gravity of at least 17, and advantageously at least 21, with the pH of the crude at at least 8, and advantageously at least 10, and heating the thus treated crude at 52°-88° C. (125°-190° F.), advantageously 60°-71° C. (140°-160° F.), for from a few minutes to a few hours. Because the specific composition and physical characteristics of the heavy oil crudes vary, not only as between crudes from different wells but also for crudes from the same well over a period of time, no single specific procedure is operative for all of the heavy oil crudes. Thus, removal of water and solids from a crude of relatively lower BS&W content and higher gravity is often accomplished more easily than for crudes of very high BS&W and low gravity. The flow diagram of FIG. 1 illustrates the method in a form applicable, e.g., to the more difficultly treated heavy oil crudes.

Here, the crude is taken as-is from the wellhead, typically with a BS&W content of 1-90% by volume, as API gravity of 10-17 and a pH of 4-8, and blended with a hydrocarbon diluent, typically a wide gasoline fraction (condensate) to bring the API gravity to at least 17, advantageously at least 20 with API gravities of 20-25 being both effective and economical. Since the crude contains not only a substantial proportion of emulsified water but also a relatively large amount of free water, the blended crude is subjected to gravitational separation, as in a conventional heater-treater, for removal of most of the free water and recovery of a blended crude of reduced water content for further treatment. An alkaline agent, typicaly a concentrated aqueous solution of NaOH, is then added to establish a pH of at least 8, advantageously 10-13, uniformly throughout the blended crude. When the pH is uniform and stable at the desired relatively high value, the additive for destabilizing the emulsion is added and the crude mixed thoroughly but under conditions of at most low shear to assure that the additive is distributed thoroughly throughout the oil phase of the blended crude. Water is then introduced, with the water advantageously being taken from the produced water recovered from the initial gravitational separation step. With continued mixing, under conditions avoiding or minimizing shear, the treated crude is then heated, typically for 15-30 minutes at 60-71° C. (140°-160° F.), to complete breaking of the emulsion. The treated crude is then separated, as by gravitational separation, centrifuging, etc., into a separately recovered clean oil phase, with a BS&W content within pipeline specifications, and an aqueous phase which also contains the oil floc and particulate solids.

Figure 2:
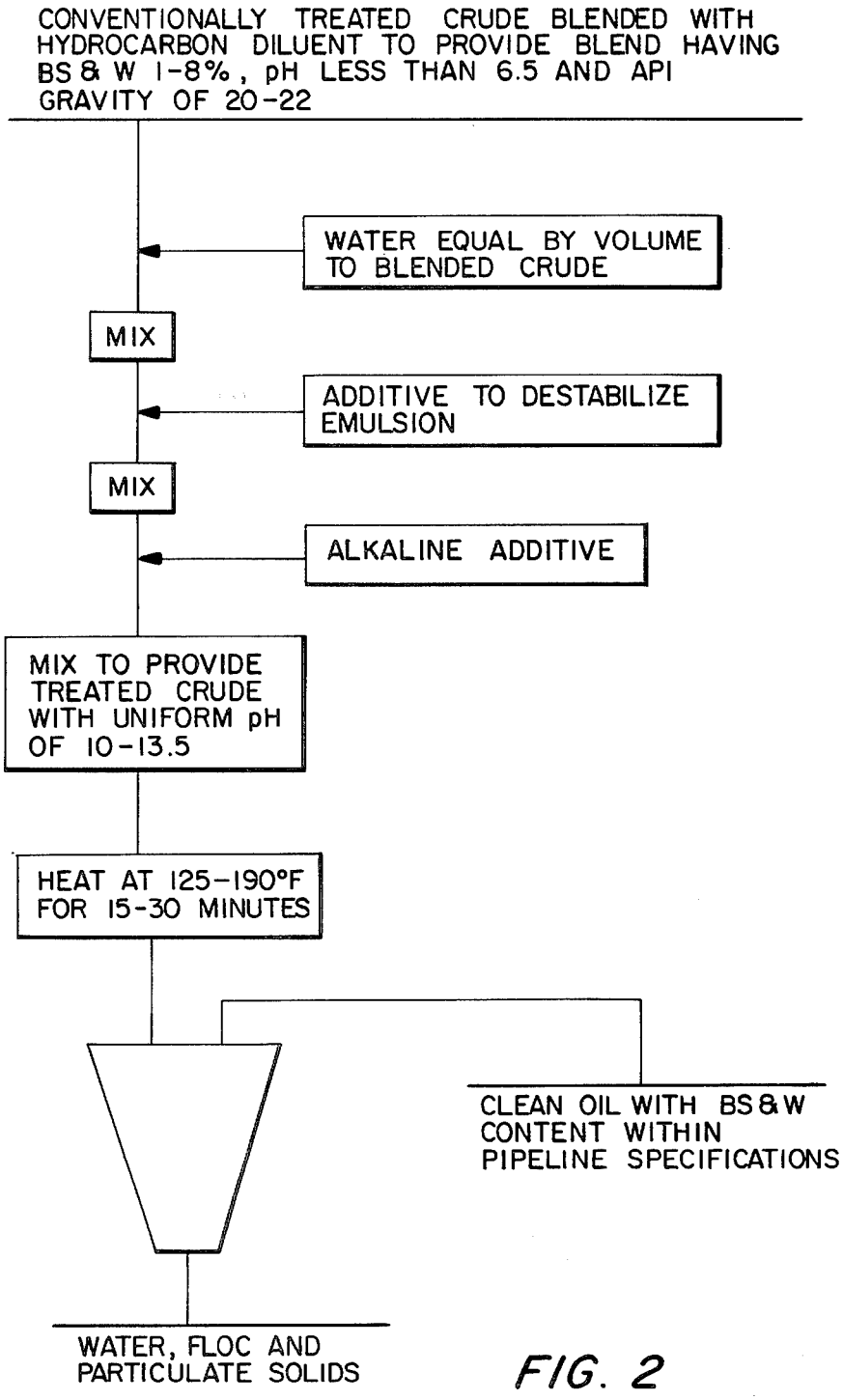

FIG. 2 illustrates an embodiment of the method useful for more easily treatable crudes, such as those which have been preliminarily blended with a hydrocarbon diluent in the field and then treated with, e.g., conventional demulsifiers. In this embodiment, water is added initially, the emulsion destabilizing agent then mixed in, the alkaline agent then introduced to bring the pH to the desired high value, the heating step then carried out, and separation and recovery of the clean oil then accomplished.

In the laboratory, the method can be carried out in a flask equipped with a heating mantle and a motorized stirrer, and the final separation and recovery can be accomplished by centrifuging. In field applications, the procedure can be accomplished on a substantially continuous basis according, for example, to the flow sheet of FIG. 3. Here, the raw crude from the wellhead is blended with sufficient hydrocarbon diluent to provide an API gravity of at least 17. Advantageously, the blend is heated to, e.g., 40.56° C. (105° F.) and maintained under mild agitation, as by recirculation, to assure uniformity of the blend. The resulting blend is then subjected to gravitational separation, to reduce the free water content, with gravitation separation being accomplished conventionally in a plurality of heater-treaters or a continuous separator, yielding produced water and a blended crude of reduced free water content. If heater-treaters are employed, the blended crude of reduced free water content is withdrawn via the floating suction line and will be at a suitable elevated temperature for further processing. If gravitational separation is accomplished without heating, the blended crude of reduced water content is advantageously passed through a suitable heater to assure that the crude will be at an elevated temperature, advantageously 35°-60° C. (95°-140° F.) preparatory to further treatment. The blended crude of reduced water content is flowed continuously to a first static mixer and, just upstream of that mixer, the alkalizing agent is metered continuously into the blended crude, the rate of addition of the alkalizing agent being chosen to raise the pH of the blended crude to at least 8, advantageously at least 10. The static mixer is advantageously of the fixed in-line helical deflector type marketed by Kenics Corp., North Andover, Mass., USA, under the trademark KENICS, so that uniform mixing is achieved without high energy shearing action and emulsification is therefore avoided. Beyond the first static mixer, the emulsion destabilizing agent is introduced continuously and the blended crude is then passed through a second static mixer to accomplish uniform distribution of that additive. Advantageously, some of the produced water from the initial gravitational separation step is recycled to the flowing crude downstream of the second static mixer and the resulting blend is then passed through a third static mixer to assure uniformity of the blend. The blended crude thus treated is flowed directly into a conventional heater-treater and there heated for at least a few minutes at 52°-88° C. (125°-190° F.). After this heating step, the clean oil fraction is recovered via the floating suction line of the heater-treater.

Figure 4:
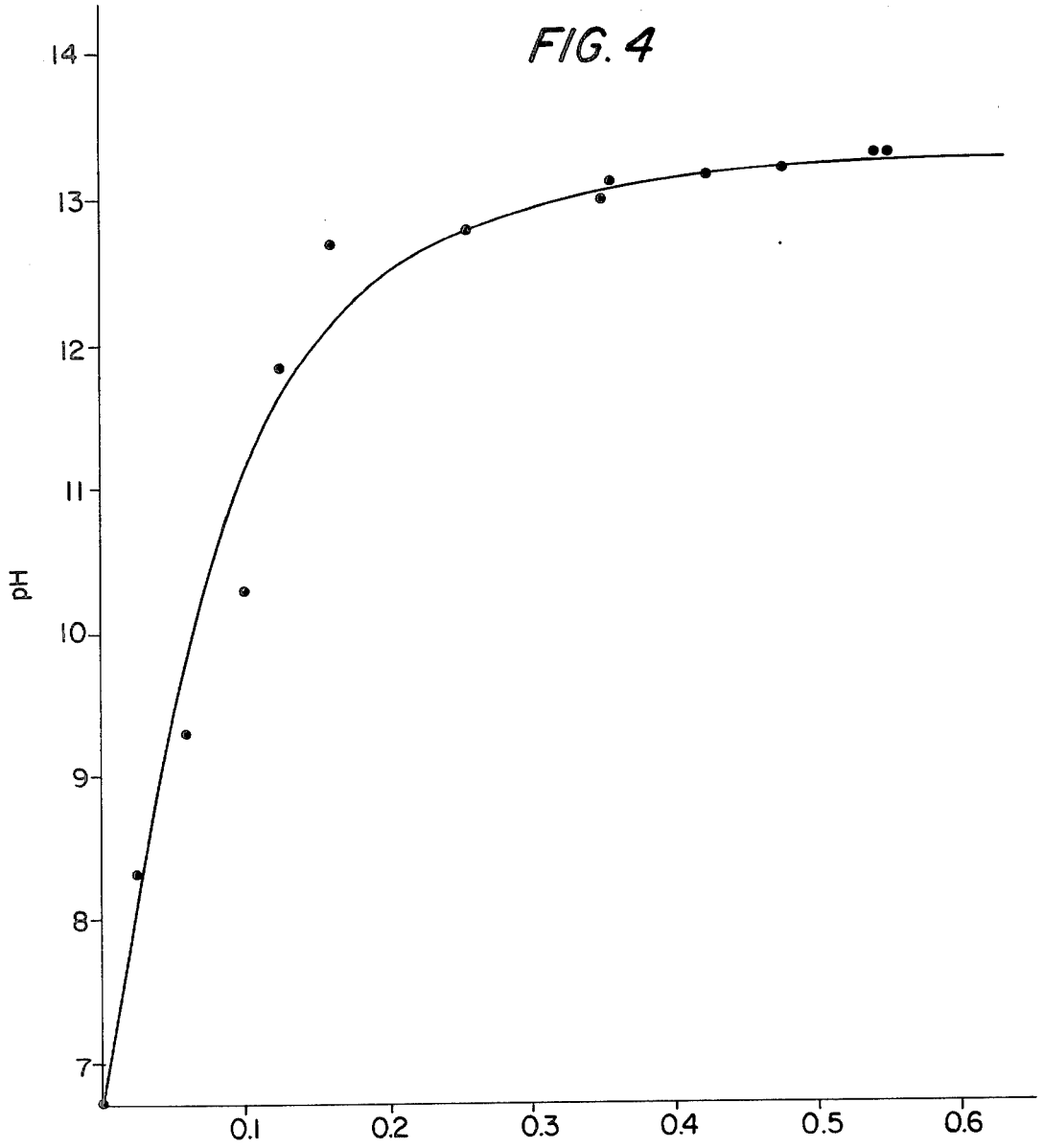

Since attaining the proper pH uniformly throughout the crude is critical to success, and the amount of alkaline agent required varies with the nature of the particular crude being treated, it is helpful to titrate a sample of the crude with the alkaline agent before selecting the amount of alkaline agent to be added for actual treatment. The titration curve shown in FIG. 4 is typical, this being for a Husky Aberfeldy crude diluted with condensate and having a pH of 6.7, a BS&W content of 13% and an API gravity of 20.9. In order to determine pH, the crude sample is prepared by blending 40 ml crude with 42 ml xylene and 18 ml isopropanol. Since the pH measurement must be made in the crude oil emulsion, it is advantageous to employ a pH meter the reference probe of which is equipped with a glass electrode and a calomel sleeve as a reverse sleeve reference. Accepting xylene and isopropanol as being essentially neutral, the titration curve of FIG. 4 shows that 0.375 parts by volume of a 32% aqueous solution of NaOH is required to raise the pH of 100 parts by volume of this particular crude to approximately 12. Though NaOH is a particularly suitable alkaline agent for raising the pH of the crude, any conventional alkalizing agent compatible with the crude can be employed, including particularly the alkali metal, alkaline earth metal and ammonium hydroxides.

Relative Proportions

As hereinbefore explained, the proportion of alkaline additive employed is best determined by titrating a sample of the crude to be treated. From the equations used to illustrate the activity of the additive employed to destabilize the emulsion, it is apparent that some of the alkaline additive employed reacts with sulfur in the crude and with hydrogen sulfide, as well as with the additive for destablizing the emulsion. Occurrence of those reactions explains the need for adding alkaline material until the pH reaches the desired level and, in some cases, adding alkaline material not only initially but also with or after the emulsion destabilizing agent. In general, the alkaline additive should be employed in an amount equal to 0.2–1.5% of the weight of the crude, with the particular proportion within that range depending upon the pH of the blended crude, the amount of inorganic sulfur carried by the crude, the amount of emulsion destabilizing agent employed, and the particular alkaline agent chosen.

The amount of the additive employed to destabilize the emulsion again depends upon the particular nature of the crude to be treated, smaller proportions often being adequate for, e.g., crudes which have already been conventionally treated in the field and crudes which inherently have lower BS&W contents, while larger proportions are usually required for crudes which have had not preliminary treatment and crudes which have high BS&W contents. In general, the proportion of the emulsion destabilizing agent will be within the range of from a few hundredths of a percent to several percent of the weight of blended crude to be treated. Thus, when the additive is ammonium bisulfite, the amount required is in the range of 0.03–0.5% based on the weight of the blended crude. When $NaHS.9H_2O$ is used, the amount employed is 0.2–1% of the weight of the blended crude. When sodium hydrosulfite is employed, the amount should be 1.9–3.8% of the weight of the blended crude.

When the crude to be treated is one taken directly from the wellhead, the amount of wide gasoline fraction or other hydrocarbon diluent employed to prepare the blended crude is simply that quantity required to increase the API gravity to at least 17.

The amount of water employed varies from nil to, e.g., 50% of the volume of the blended crude being treated, with the upper limit being determined primarily by economics.

The following examples are typical for laboratory demonstration of the method.

EXAMPLE 1

A blend of 27.5 parts by volume of a Husky Aberfeldy fireflood crude and 22.5 parts by volume of condensate was prepared, yielding a blended crude having an API gravity of 20.9, a pH of 6.6 and a BW&W content of approximately 50% by volume. 200 ml of the blended crude was placed in a 1000 ml 3-neck flask equipped with a heating mantle, a motor-driven propeller agitator and a thermometer. 0.624 ml of a 10 molar sodium hydroxide aqueous solution was added with good agitation, agitation being continued until the pH was stable and in excess of 13. With agitation continuing, 20 ml of a 6% $NaHS\ 9H_2O$ aqueous solution was added and agitation then continued at low speed for 5 min. 180 ml of distilled water was then added, and with agitation continuing at slow speed, the heating mantle was activated and the treated and diluted crude maintained at 68°–78° C. for 30 min. The agitator was stopped, the heating mantle deactivated and the liquid allowed to stand for 5 min. A copious fallout of clear water was observed. The blended crude was decanted into 100 ml tapered oil centrifuge tubes and centrifuged for 20 min. in a Model EXD International Centrifuge, with the tubes then exhibiting an upper clean oil phase, an intermediate water phase and a lower phase containing solids and emulsion. The BS&W content of the oil phase was determined according to ANSI/ASTM D 96-73 and the BS&W value so determined was nil.

EXAMPLE 2

Thirteen crudes from the Lloydminster area were blended to provide a blended and dewatered crude having a BS&W content of 2.3% by volume, and the blend was treated using the same procedure and equipment as in Example 1. A sample of the blend was divided into 4 aliquots, each aliquot was centrifuged, and the BS&W for all four aliquots was then determined. All BS&W values were below 0.5% by volume, the average being 0.25%.

EXAMPLE 3

Sales oil was obtained from the Aberfeldy field and found to have (after conventional treatment) a BS&W content of 1.85% by volume, a pH of 6.5 and an API gravity of 18.3. 300 ml of the sales oil was placed in the 1000 ml flask and, with agitation 13 ml of a 50% NaOH aqueous solution was added, followed by 39 ml of a saturated solution of $NaHS\ 9H_2O$, the pH stabilizing at 13.2. The treated crude was then mixed with an equal amount by volume of distilled water, the blend then heated for 30 min. at 60° C. and, after heating, centrifuged as in Example 1. The BS&W content of the clean oil phase was nil.

EXAMPLE 4

Using the same procedure and equipment as in Example 1, a Husky Aberfeldy fireflood crude having a BS&W content of 10% by volume, a pH of 6–6.5 and an API gravity of approximately 20 was treated. The pH of the blended crude was adjusted to 13.5 by addition of 2 molar aqueous NaOH solution. 5 ml of 6% $NaHS\ 9H_2O$ aqueous solution was then added and, after thorough blending, the blend was diluted with an equal volume of distilled water. The blend was then heated for 2 hrs. at 50° C. and centrifuged for 20 minutes as in Example 1. The BS&W content of the clean oil phase was found to be 0.4% by volume.

EXAMPLE 5

Using the same procedure and equipment as in Example 1, a fireflood crude having an initial BS&W content of 20% by volume and a pH of 5.9 was blended with condensate to bring the API gravity of the blend to 21. 750 ml of the resulting blended crude was placed in the flask and 50 ml of a 10 molar aqueous solution of NaOH added with slow speed mixing, bringing the pH to 13. 50 ml of an aqueous solution of 60% ammonium bisulfite was then added with slow speed mixing. With mixing continuing, 150 ml of distilled water was then added and the resulting blend was heated at 60° C. for 30 min. The material was centrifuged and the BS&W content of the clean oil recovered was found to be 0.4% by volume.

EXAMPLE 6

Figure 3:
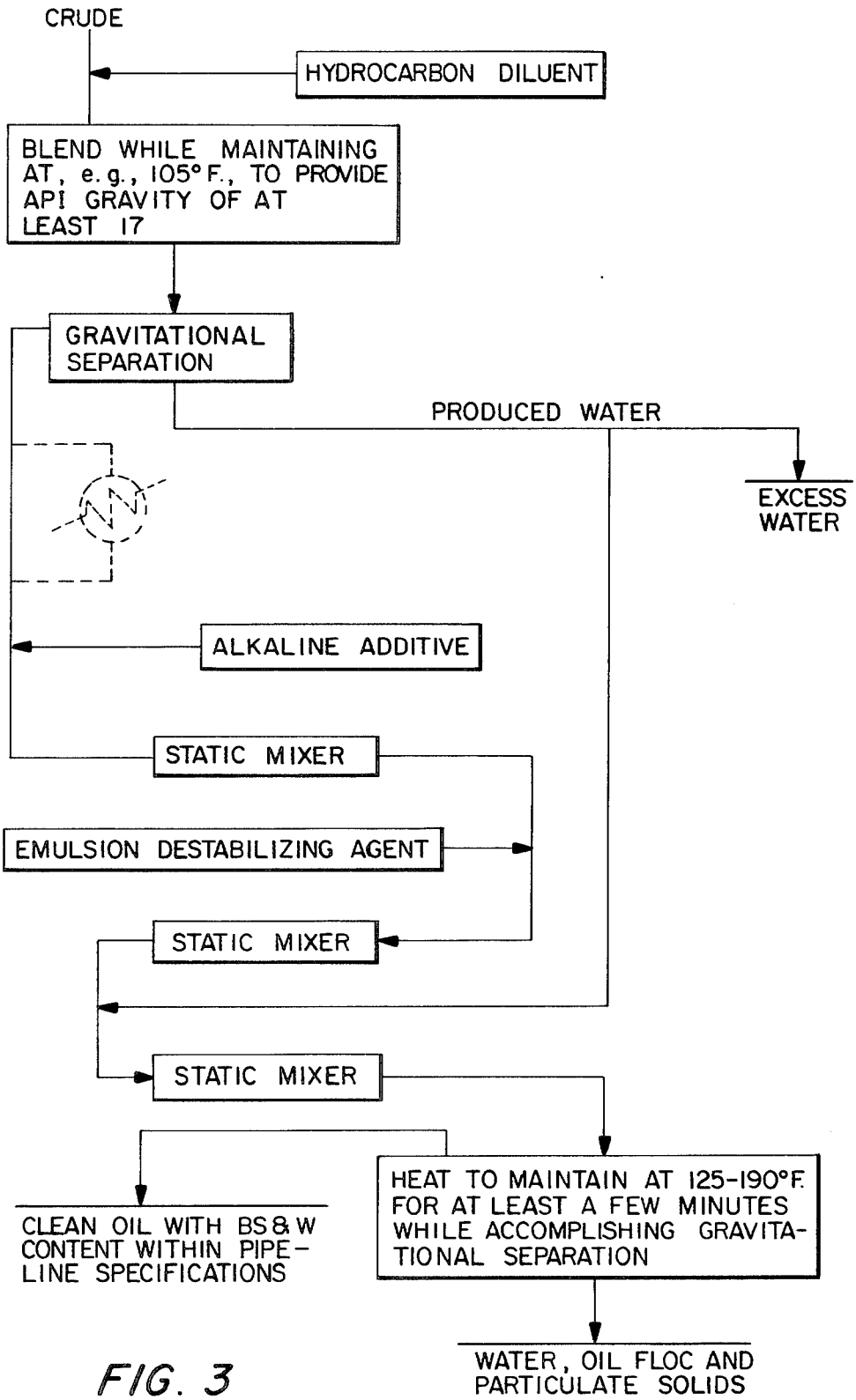

Employing a semiworks field installation generally according to the flow sheet of FIG. 3, a blended fireflood crude from the Husky Aberfeldy Field is passed continuously through the system at a rate of 60 cubic meters per 24 hour period. The blended crude contains condensate to bring the API gravity to 21.9 and had a BS&W content of 12% and a pH of 6. The blended crude is heated to 28° C. (82° F.) after gravitational separation of free water and a 10 molar aqueous solution of NaOH is metered in at the rate of 3.5 liters per cubic meter of the blended, dewatered crude, providing a pH of approximately 11. After the first static mixer, a 60% ammonium bisulfite aqueous solution is metered in, as the emulsion destabilizer, at the rate of 1.3 liters per cubic meter of the alkalyzed blended crude. After the second static mixer, produced water at a pH of 5 from the initial gravitational separation step is introduced at the rate of 20 liters per cubic meter of the treated crude, the total treated crude then passing through the final static mixer to a conventional heater-treater where the treated crude is maintained at 50°-70° (122°-158° F.). The clean oil is drawn from the surface of the heater-treater via an overflow line into a sales tank, with the oil in the sales tank maintained at 49°-64° C. (120°-147° F.), the clean oil being drawn from the surface in the sales tank, via a floating suction line, periodically for tank truck loading. After a 4 day combined residence time in the heater-treater, the BS&W content of the clean oil delivered from the sales tank will not exceed 0.4% by weight. The feed rate of 60 cubic meters per 24 hours equals approximately 85 barrels per 24 hours.

EXAMPLE 7

To demonstrate that the method can be practiced with additional treating agents and with variations in the order of addition of the materials, the following laboratory run is illustrative. 70 ml of blended and dewatered Kitscoty fireflood crude at an API gravity of 21, a pH of 4.9 and a BS&W content of 28% by volume; 10 ml of produced water at a pH of 4.9; 1 ml of a 10 molar aqueous NaOH solution; 10 ml of a 60% by weight ammonium bisulfite solution; 0.02 ml of a conventional surfactant (CHAMPION BX6079, provided by Champion Chemical Co., Edmonton, Alberta, Canada) and 1 g alum in solid, particulate form were combined in a 100 ml tapered centrifuge tube and shaken to provide uniformity. An additional 1 ml of 10 molar aqueous NaOH solution was then added and shaking continued. The centrifuge tube and contents were then heated in a water bath for 40 min. at 60° C. (140° F.). The blend thus treated was centrifuged for 20 min. at 1250 r.p.m. to provide a clean oil phase. The BS&W content of the clean oil was found to be 0.1% by volume. Yield of clean oil was 98% by volume, based on the oil content of the original blended crude.

EXAMPLE 8

Following the procedure of Example 7, numerous laboratory runs were made with various heavy oil crudes and refinery slop oils, as follows:

| Crude | Original BS & W (%) | API Gravity | BS & W Content Clean Oil (%) |
|---|---|---|---|
| Brascan/Lindberg | 17 | 18.6 | 0.4 |
| Golden Lake | 40 | 18.6 | 0.2 |
| Silverdale | 43 | 17.9 | 0.2 |
| Murphy Oil | 2 | 19.4 | 0.3 |
| Husky Slop Oil | 56 | 30 | Nil |

EXAMPLE 9

Though some heavy oil crudes can be treated successfully by the method when the pH of the crude is raised only to, e.g., 8-11, achieving a higher pH becomes increasingly important to success when faced with crudes of higher BS&W contents and/or more stable emulsions. In some cases, it is best to supplement the initial alkalyzing step. The following is illustrative. A raw Aberfeldy fireflood crude was combined with condensate to provide a blended crude having an API gravity of 20.3, a pH of 5.3 and a BS&W content of 27% by volume. 90 ml of the blended crude was used and 2 ml of an aqueous 10 molar NaOH solution was added to bring the pH to 12.7. 0.015 ml of the CHAMPION surfactant of Example 7 was then added, followed by 0.75 ml of an aqueous 60% ammonium bisulfite solution as the emulsion destabilizer. 0.15 g of alum was dissolved in 5 ml of produced water at 140° F. (60° C.) and the total resulting solution added to the treated crude. As a supplementary alkalyzing treatment, 1 ml of aqueous 10 molar NaOH was then added. The resulting blend was agitated and the treated crude was then heated for 20 min. at 60° C. (140° F.), then centrifuged for 20 min. at 1250 r.p.m. The BS&W content of the clean oil obtained was nil. Yield of clean oil was 96.8% based on the volume of oil in the original crude.

What is claimed is:

1. The method for reducing to pipeline specifications the BS&W content of a heavy crude oil having a substantial water content comprising both free water and water present as the disperse phase of a stable water-in-oil emulsion as well as a significant content of finely particulate inorganic solids with a significant portion of the solids content being inorganic sulfur which is soluble in toluene but not in heptane and which is of a particle size not substantially exceeding 1 micron, comprising blending the crude oil with a liquid hydrocarbon diluent in an amount producing a blended crude oil having an API gravity of at least 17;

adjusting the pH of the blended crude to at least 8;

providing in uniform distribution through the blended crude oil while the pH of the blended crude oil is at least 8 a small proportion of at least one additive selected from the group consisting of alkali metal, alkaline earth metal and ammonium hydrosulfites, hydrosulfides and monosulfides, the amount of the at least one additive being in the range of from a few hundredths of a percent to several percent of the weight of the blended crude;

heating the blended crude oil at 52°-88° C. (125°-190° F.) for at least a few minutes;

then separating the treated crude into at least an oil phase and a water phase; and recovering the oil phase as a clean blended crude oil having a BS&W content within pipeline specifications.

2. The method according to claim 1, wherein the heavy crude oil is one produced by a thermal recovery procedure.

3. The method according to claim 1, wherein the step of blending the crude oil with a liquid hydrocarbon diluent is carried out to produce a blended crude oil having an API gravity of at least 21.

4. The method according to claim 1, wherein the pH of the blended crude is adjusted to at least 11.

5. The method according to claim 13, wherein the blended crude is heated to 60°–71° C. (140°–160° F.)

6. The method according to claim 1 and further comprising subjecting the blended crude oil to gravitational separation before addition of said at least one additive, whereby free produced water is separated from the blended crude oil; and wherein the blended crude oil recovered from said gravitational separation step is passed continuously through three successive mixing zones;

the pH of the blended crude oil is adjusted to at least 8 by introducing into the blended crude oil before said mixing zones at least one alkalyzing agent selected from the group consisting of the alkali metal, alkaline earth metal and ammonium hydroxides;

said at least one additive is then introduced into the blended crude oil between the first and second of said mixing zones; and a portion of the free water recovered from said gravitational separation step is then introduced into the blended crude oil between the second and third of said mixing zones.

7. The method according to claim 6, wherein said mixing zones are constituted at least in part by static mixers.

8. The method according to claim 6, wherein said step of separating clean oil from the remainder of the crude is accomplished by gravitational separation; and said step of heating the blended crude oil is carried out during said last-mentioned step.

9. The method according to claim 2, wherein said at least one additive is ammonium bisulfite; and the amount of ammonium bisulfite employed is in the range of 0.03–0.5% based on the weight of the blended crude.

10. The method according to claim 9, wherein the heavy crude oil is a fireflood crude; and the step of blending the crude oil with a liquid hydrocarbon diluent is carried out to produce a blended crude oil having an API gravity of 20–25.

* * * * *

UNITED STATES PATENT AND TRADEMARK OFFICE

CERTIFICATE OF CORRECTION

PATENT NO. : 4,477,337

DATED : October 16, 1984

INVENTOR(S) : Clifford P. Ronden et al

It is certified that error appears in the above—identified patent and that said Letters Patent is hereby corrected as shown below: Title page:

In Item 75 of the heading, "Boylance" should be --Roylance--

Column 7, line 20, "as" should be --an--

Column 9, line 31, "not" should be --no--

Column 9, line 59, "BW&W" should be --BS&W--

Signed and Sealed this

*Sixteenth* Day of *April 1985*

[SEAL]

*Attest:*

DONALD J. QUIGG

*Attesting Officer* *Acting Commissioner of Patents and Trademarks*